US011085445B2

(12) United States Patent
Imai et al.

(10) Patent No.: US 11,085,445 B2
(45) Date of Patent: Aug. 10, 2021

(54) SCROLL COMPRESSOR WITH INTEGRAL DRIVING SHAFT AND ECCENTRIC SHAFT

(71) Applicant: Panasonic Intellectual Property Management Co., Ltd., Osaka (JP)

(72) Inventors: Yusuke Imai, Shiga (JP); Sadayuki Yamada, Gunma (JP); Atsushi Sakuda, Shiga (JP); Takashi Morimoto, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 155 days.

(21) Appl. No.: 16/320,058

(22) PCT Filed: Jul. 14, 2017

(86) PCT No.: PCT/JP2017/025685
§ 371 (c)(1),
(2) Date: Jan. 23, 2019

(87) PCT Pub. No.: WO2018/021058
PCT Pub. Date: Feb. 1, 2018

(65) Prior Publication Data

US 2019/0271312 A1 Sep. 5, 2019

(30) Foreign Application Priority Data

Jul. 29, 2016 (JP) ..... JP2016-149928

(51) Int. Cl.
*F03C 2/00* (2006.01)
*F03C 4/00* (2006.01)
(Continued)

(52) U.S. Cl.
CPC ..... *F04C 18/0246* (2013.01); *F04C 18/0215* (2013.01); *F04C 23/008* (2013.01);
(Continued)

(58) Field of Classification Search
CPC ..... F04C 18/0215; F04C 18/0246; F04C 18/0253; F04C 23/008; F04C 27/005; F04C 29/12; F04C 2250/10; F04C 2250/20
See application file for complete search history.

(56) References Cited

U.S. PATENT DOCUMENTS 5,040,958 A 8/1991 Arata et al.
2015/0152868 A1* 6/2015 Fu ..... F04C 18/0215 418/55.5
(Continued)

FOREIGN PATENT DOCUMENTS

CN 1218878 A 6/1999
EP 3159542 A1 4/2017
(Continued)

OTHER PUBLICATIONS

International Search Report of PCT application No. PCT/JP2017/025685 dated Sep. 26, 2017.
(Continued)

*Primary Examiner* — Theresa Trieu
(74) *Attorney, Agent, or Firm* — Hamre, Schumann, Mueller & Larson, P.C.

(57) ABSTRACT

It is assumed that a distance between a center portion of fixed scroll end plate and an outer peripheral portion at a distal end of fixed spiral wrap of fixed scroll is Ds, and that a distance between a center portion of orbiting scroll end plate and a portion included in a bottom face of an orbiting spiral wrap of orbiting scroll and facing the outer peripheral portion at the distal end of the fixed spiral wrap of the fixed scroll is Do. Further, assuming that an orbiting radius of orbiting scroll is ε, the orbiting radius being a distance between a center of eccentric shaft and a center of driving shaft, a relationship Ds+ε≤Do is satisfied.

3 Claims, 9 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/12*** | (2006.01) |
| ***F04C 23/00*** | (2006.01) |
| ***F04C 27/00*** | (2006.01) |

(52) U.S. Cl.
CPC ..... *F04C 27/005* (2013.01); *F04C 29/12* (2013.01); *F04C 2250/10* (2013.01); *F04C 2250/20* (2013.01)

(56) References Cited

U.S. PATENT DOCUMENTS

| | | | | |
|---|---|---|---|---|
| 2016/0363121 | A1 | 12/2016 | Yamada et al. | |
| 2017/0268511 | A1* | 9/2017 | Imai ..... | F04C 18/0215 418/55.5 |

FOREIGN PATENT DOCUMENTS

| | | | |
|---|---|---|---|
| JP | 2010-196608 | | 9/2010 |
| JP | 2014-234785 | | 12/2014 |
| MY | 133032 | A | 10/2007 |
| WO | 2014/108973 | | 7/2014 |
| WO | 2015/194119 | | 12/2015 |

OTHER PUBLICATIONS

The Extended European Search Report dated Jun. 27, 2019 for the related European Patent Application No. 17834066.7, dated Jun. 27, 2019, 7 pages.

English Translation of Chinese Search Report dated Jul. 3, 2020 for the related Chinese Patent Application No. 201780045456.1, 2 pages.

* cited by examiner

SCROLL COMPRESSOR WITH INTEGRAL DRIVING SHAFT AND ECCENTRIC SHAFT

This application is a U.S. national stage application of the PCT International Application No. PCT/JP2017/025685 filed on Jul. 14, 2017, which claims the benefit of foreign priority of Japanese patent application No. 2016-149928 filed on Jul. 29, 2016, the contents all of which are incorporated herein by reference.

TECHNICAL FIELD

The present invention relates to a scroll compressor.

BACKGROUND ART

A sealed-type scroll compressor known in recent years includes a partitioning plate inside a compression container, and further includes, in a lower-pressure chamber partitioned by the partitioning plate, a compression element provided with a fixed scroll and an orbiting scroll, and an electric element which turns the orbiting scroll.

As this type of sealed-type scroll compressor, there is currently proposed a scroll compressor configured to discharge a refrigerant compressed by the compression element to a higher-pressure chamber partitioned by the partitioning plate via a discharge port of the fixed scroll in a state where a boss portion of the fixed scroll is fitted to a retaining hole of the partitioning plate (for example, see PTL 1).

CITATION LIST

Patent Literature

PTL 1: Unexamined Japanese Patent Publication No. 2014-234785

SUMMARY OF THE INVENTION

However, PTL 1 does not disclose a relationship among a distance between a center portion of an end plate of the fixed scroll and an outer circumferential portion of a distal end of a fixed spiral wrap of the fixed scroll, distance between a center portion of an end plate of an orbiting scroll and a portion included in a bottom face of an orbiting spiral wrap of the orbiting scroll and facing the outer circumferential portion of the distal end of the fixed spiral wrap of the fixed scroll, and an orbiting radius of the orbiting scroll, the orbiting radius being a distance between a center of an eccentric shaft and a center of a driving shaft.

The present invention defines a relationship among a distance between a center portion of an end plate of a fixed scroll and an outer circumferential portion of a distal end of a fixed spiral wrap of the fixed scroll, a distance between a center portion of an end plate of an orbiting scroll and a portion included in a bottom surface of an orbiting spiral wrap of the orbiting scroll and facing the outer circumferential portion of the distal end of the fixed spiral wrap of the fixed scroll, and an orbiting radius of the orbiting scroll, the orbiting radius being a distance between a center of an eccentric shaft and a driving shaft. Based on this definition, a scroll compressor is provided which is capable of preventing a drop of the bottom face of the orbiting spiral wrap of the orbiting scroll from an upper face of the fixed spiral wrap of the fixed scroll during orbiting, and thereby preventing abrasion of components, and reducing sliding losses.

A scroll compressor according to the present invention includes: a fixed scroll; an orbiting scroll that engages with the fixed scroll and forms a compression chamber; a rotation-restraining member that prevents rotation of the orbiting scroll; a main bearing that supports the orbiting scroll; a driving shaft supported by the main bearing; and an eccentric shaft provided at one end of the driving shaft. The fixed scroll, the orbiting scroll, the rotation-restraining member, the main bearing, the driving shaft, and the eccentric shaft are stored inside a sealed container. The driving shaft and the eccentric shaft are disposed integrally with each other. The eccentric shaft is supported by a boss portion of the orbiting scroll. Assuming that a distance between a center portion of an end plate of the fixed scroll and an outer peripheral portion of a distal end of a fixed spiral wrap of the fixed scroll is Ds, that a distance between a center portion of an end plate of the orbiting scroll and a portion included in a bottom face of an orbiting spiral wrap of the orbiting scroll and facing the outer peripheral portion at the distal end of the fixed spiral wrap is Do, and that an orbiting radius of the orbiting scroll is ε, the orbiting radius being a distance between a center of the eccentric shaft and a center of the driving shaft, a relationship $Ds+\varepsilon \leq Do$ is satisfied.

This configuration prevents a drop of the bottom face of the orbiting spiral wrap of the orbiting scroll from an upper face of the fixed spiral wrap of the fixed scroll during orbiting, thereby preventing edge contact and abrasion of components. Moreover, sliding losses produced by partial contact decrease, whereby efficiency of the scroll compressor improves.

DESCRIPTION OF EMBODIMENT

A scroll compressor according to a first exemplary embodiment of the present invention will be hereinafter described with reference to the drawings. The present invention is not limited to the first exemplary embodiment described herein.

First Exemplary Embodiment

Figure 1:
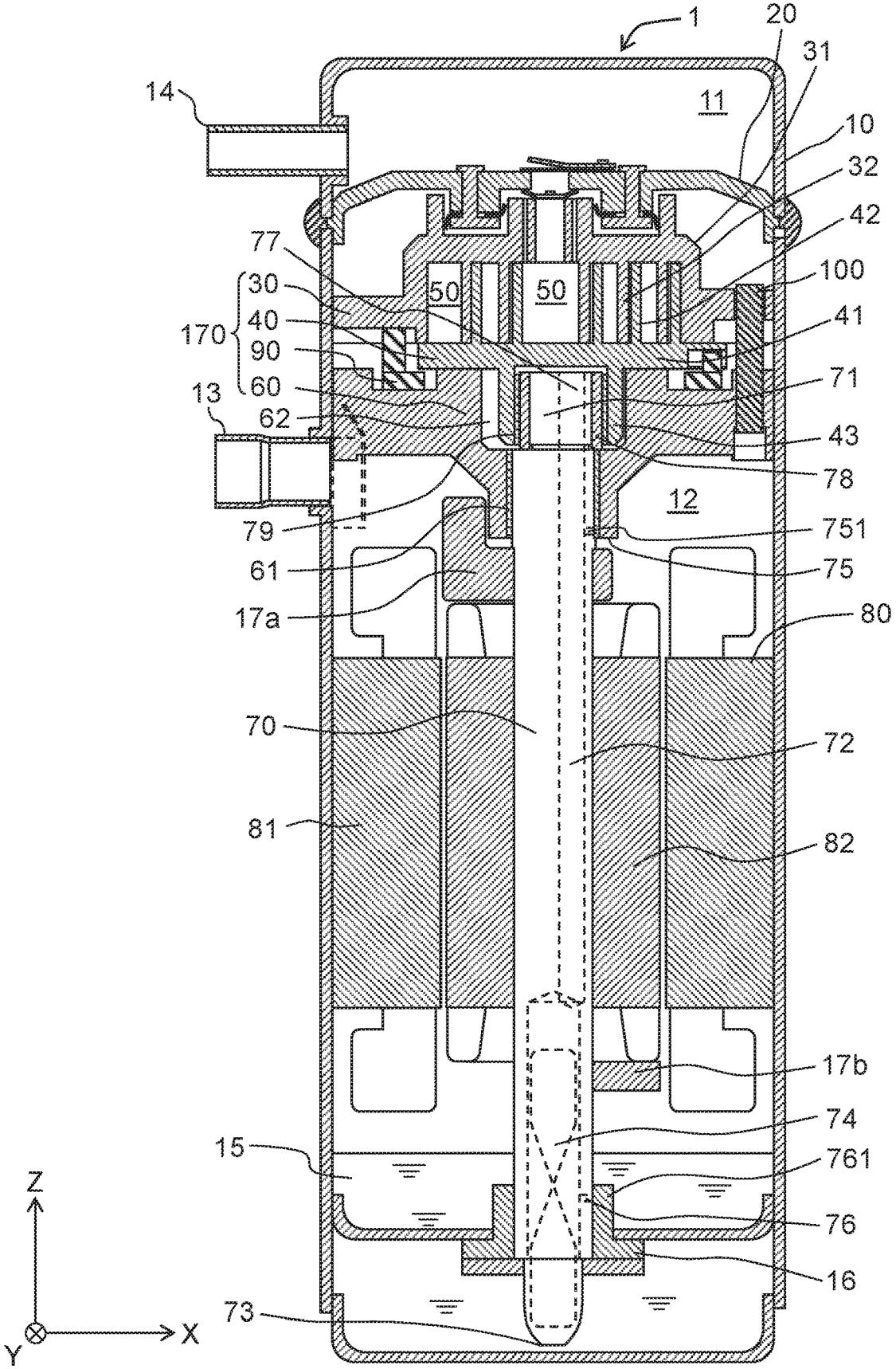
FIG. 1 is a longitudinal sectional view illustrating a configuration of a scroll compressor according to a first exemplary embodiment of the present invention.

FIG. 1 is a longitudinal sectional view illustrating the scroll compressor according to the first exemplary embodiment of the present invention. FIG. 1 shows a cross section taken along line 1-1 in FIG. 3. As illustrated in FIG. 1, compressor 1 includes, as an outer casing, sealed container 10 which is cylindrical and has a longitudinal direction extending in a vertical direction. In the present specification, the vertical direction corresponds to a Z-axis direction in each of the drawings.

Compressor 1 is a sealed-type scroll compressor which includes compression mechanism unit 170 for compressing a refrigerant, and electric motor 80 for driving compression mechanism unit 170 inside sealed container 10. Compression mechanism unit 170 includes at least fixed scroll 30, orbiting scroll 40, main bearing 60, and Oldham ring 90.

Partitioning plate 20 is provided in an upper region of an interior of sealed container 10 to separate the interior of sealed container 10 into an upper part and a lower part. Partitioning plate 20 divides the interior of sealed container 10 into higher-pressure space 11 and lower-pressure space 12. Higher-pressure space 11 is a space filled with a higher-pressure refrigerant after compression by compression mechanism unit 170, while lower-pressure space 12 is a space filled with a lower-pressure refrigerant before compression by compression mechanism unit 170.

Sealed container 10 includes refrigerant suction pipe 13 which communicatively connects an outside of sealed container 10 and lower-pressure space 12, and refrigerant discharge pipe 14 which communicatively connects the outside of sealed container 10 and higher-pressure space 11. Compressor 1 introduces a lower-pressure refrigerant into lower-pressure space 12 from a refrigeration cycle circuit (not shown) provided outside sealed container 10 via refrigerant suction pipe 13.

A higher-pressure refrigerant compressed by compression mechanism unit 170 is first introduced into higher-pressure space 11. The higher-pressure refrigerant is then discharged from the higher-pressure space 11 to the refrigeration cycle circuit via refrigerant discharge pipe 14. Oil reservoir 15 storing lubricant is disposed at a bottom of lower-pressure space 12.

Compressor 1 includes fixed scroll 30 and orbiting scroll 40 disposed in lower-pressure space 12. Fixed scroll 30 is a non-orbiting scroll according to the present invention. Fixed scroll 30 is disposed below and adjacent to partitioning plate 20. Orbiting scroll 40 is disposed below fixed scroll 30 in engagement with fixed scroll 30.

Fixed scroll 30 includes fixed scroll end plate 31 having a disk shape, and fixed spiral wrap 32 having a spiral shape and standing on a lower face of fixed scroll end plate 31. Orbiting scroll 40 includes orbiting scroll end plate 41 having a disk shape, orbiting spiral wrap 42 having a spiral shape and standing on an upper face of orbiting scroll end plate 41, and lower boss portion 43. Lower boss portion 43 is a cylindrical projection provided substantially at a center of a lower face of orbiting scroll end plate 41.

Fixed scroll end plate 31 corresponds to a first end plate of the present invention, while fixed spiral wrap 32 corresponds to a first spiral body of the present invention. Orbiting scroll end plate 41 corresponds to a second end plate of the present invention, while orbiting spiral wrap 42 corresponds to a second spiral body of the present invention.

Compression chamber 50 is disposed between orbiting scroll 40 and fixed scroll 30 by engagement between orbiting spiral wrap 42 of orbiting scroll 40 and fixed spiral wrap 32 of fixed scroll 30. Compression chamber 50 is disposed on an inner wall (described below) side and an outer wall (described below) side of orbiting spiral wrap 42.

Main bearing 60 which supports orbiting scroll 40 is provided below fixed scroll 30 and orbiting scroll 40. Main bearing 60 includes boss storage portion 62 provided substantially at a center of an upper face of main bearing 60, and bearing portion 61 provided below boss storage portion 62.

Boss storage portion 62 is a recess storing lower boss portion 43 of orbiting scroll 40. Bearing portion 61 is a through hole which has an upper end opened to boss storage portion 62, and a lower end opened to lower-pressure space 12. The upper face of main bearing 60 supports orbiting scroll 40, while bearing portion 61 of main bearing 60 supports driving shaft 70.

Driving shaft 70 is a shaft which has a longitudinal direction extending in the vertical direction in FIG. 1. On end of driving shaft 70 is supported by bearing portion 61, while the other end of driving shaft 70 is supported by sub bearing 16. Sub-bearing 16 is a bearing provided below lower-pressure space 12, preferably within oil reservoir 15.

Eccentric shaft 71 decentered from a shaft center of driving shaft 70 is provided at an upper end of driving shaft 70. Eccentric shaft 71 is slidably inserted through an inner circumference of cylindrical lower boss portion 43 via swing bush 78 and orbiting bearing 79. Lower boss portion 43 turns in accordance with driving of eccentric shaft 71.

Oil path 72 through which lubricant passes is disposed inside driving shaft 70. Oil path 72 is a through hole disposed axial direction of driving shaft 70. One end of oil path 72 constitutes suction port 73 disposed at a lower end of driving shaft 70, and opens inside oil reservoir 15. Paddle 74 which draws up lubricant from suction port 73 into oil path 72 is provided above suction port 73.

First branch oil path 751 and second branch oil path 761 are disposed inside driving shaft 70. One end of first branch oil path 751 constitutes first oil filler 75, and opens to a bearing face of bearing portion 61, while the other end of first branch oil path 751 communicates with oil path 72. One end of second branch oil path 761 constitutes second oil filler 76, and opens to a bearing face of sub-bearing 16, while the other end of second branch oil path 761 communicates with oil path 72. An upper end of oil path 72 constitutes third oil filler 77, and opens to an interior of boss storage portion 62.

Driving shaft 70 is connected to electric motor 80. Electric motor 80 is disposed between main bearing 60 and sub-bearing 16. Electric motor 80 is a monophase alternating current motor driven by monophase alternating current power. Electric motor 80 includes stator 81 fixed to sealed container 10, and rotor 82 disposed inside stator 81.

Driving shaft 70 is fixed to rotor 82. Driving shaft 70 includes balance weight 17*a* provided above rotor 82, and balance weight 17*b* provided below rotor 82. Balance weight 17*a* and balance weight 17*b* are disposed at positions displaced from each other by 180 degrees in a circumferential direction of driving shaft 70.

Driving shaft 70 rotates in a balanced manner between centrifugal force of balance weight 17*a* and balance weight 17*b*, and centrifugal force generated by revolution of orbiting scroll 40. Balance eight 17*a* and balance weight 17*b* may be provided on rotor 82.

Rotation-restraining member (Oldham ring) 90 is provided between orbiting scroll 40 and main bearing 60. Oldham ring 90 prevents rotation of orbiting scroll 40. Accordingly, orbiting scroll 40 turns without rotation relative to fixed scroll 30.

Fixed scroll 30, orbiting scroll 40, electric motor 80, Oldham ring 90, and main bearing 60 are disposed in lower-pressure space 12. Fixed scroll 30 and orbiting scroll 40 are disposed between partitioning plate 20 and main bearing 60.

An elastic body (not shown) is provided on compression mechanism unit 170 including at least fixed scroll 30, orbiting scroll 40, main bearing 60, and Oldham ring 90. More specifically, the elastic body is provided on one of fixed scroll 30 and orbiting scroll 40 to urge fixed scroll 30 and orbiting scroll 40 in directions away from each other.

Partitioning plate 20 and main bearing 60 are fixed to sealed container 10. At least one of fixed scroll 30 and orbiting scroll 40, which is provided with the elastic body, is movable at least in a part of a space between partitioning plate 20 and main bearing 60, more specifically, between partitioning plate 20 and orbiting scroll 40, or between fixed scroll 30 and main bearing 60 in the axial direction.

More specifically, fixed scroll 30 is provided in such a manner as to be movable in the axial direction (vertical direction in FIG. 1) relative to columnar members 100 provided on main bearing 60. A lower end of each of columnar members 100 is inserted into and fixed to bearing-side hole 102 (see FIG. 6 described below), while an upper end of each of columnar members 100 is slidably inserted into scroll-side hole 101 (see FIGS. 3 and 5 described below).

Columnar members 100 regulate rotation and radial movement of fixed scroll 30, and allow axial movement of fixed scroll 30. More specifically, fixed scroll 30 is supported on main bearing 60 via columnar members 100, and is movable in the axial direction in a part of the space between partitioning plate 20 and main bearing 60, more specifically; between partitioning plate 20 and orbiting scroll 40. A plurality of columnar members 100 are disposed at predetermined intervals in the circumferential direction. Preferably, the plurality of columnar members 100 are disposed at equal intervals in the circumferential direction.

Columnar members 100 may be provided on fixed scroll 30. More specifically, a lower end of each of columnar members 100 may be slidably inserted into bearing-side hole 102 (see FIG. 6 described below), while an upper end of each of columnar members 100 may be inserted into and fixed to scroll-side hole 101 (see FIGS. 3 and 5 described below).

Operations and effects of compressor 1 will now be described. Driving shaft 70 is rotated together with rotor 82 by driving of electric motor 80. Eccentric shaft 71 and Oldham ring 90 allow orbiting scroll 40 to turn around a center axis of driving shaft 70 without rotation. As a result, a capacity of compression chamber 50 defined by fixed scroll 30 and orbiting scroll 40 is decreased, whereby a refrigerant in compression chamber 50 is compressed.

The refrigerant is introduced from refrigerant suction pipe 13 into lower-pressure space 12. The refrigerant in lower-pressure space 12 is then introduced from an outer circumference of orbiting scroll 40 into compression chamber 50 via notch 61*a* (see FIG. 6) disposed in bearing portion 61. The refrigerant compressed in compression chamber 50 passes through higher-pressure space 11, and is discharged from refrigerant discharge pipe 14.

Lubricant stored in oil reservoir 15 is drawn up from suction port 73 to an upper portion of oil path 72 along paddle 74 in accordance with rotation of driving shaft 70. The lubricant thus drawn up is supplied from first oil filler 75, second oil filler 76, and third oil filler 77 to bearing portion 61, sub-bearing 16, and boss storage portion 62, respectively.

The lubricant drawn up to boss storage portion 62 is introduced to sliding surfaces of main bearing 60 and orbiting scroll 40, and discharged through return path 63 (see FIG. 6 described below) to return to oil reservoir 15.

Figure 2A:
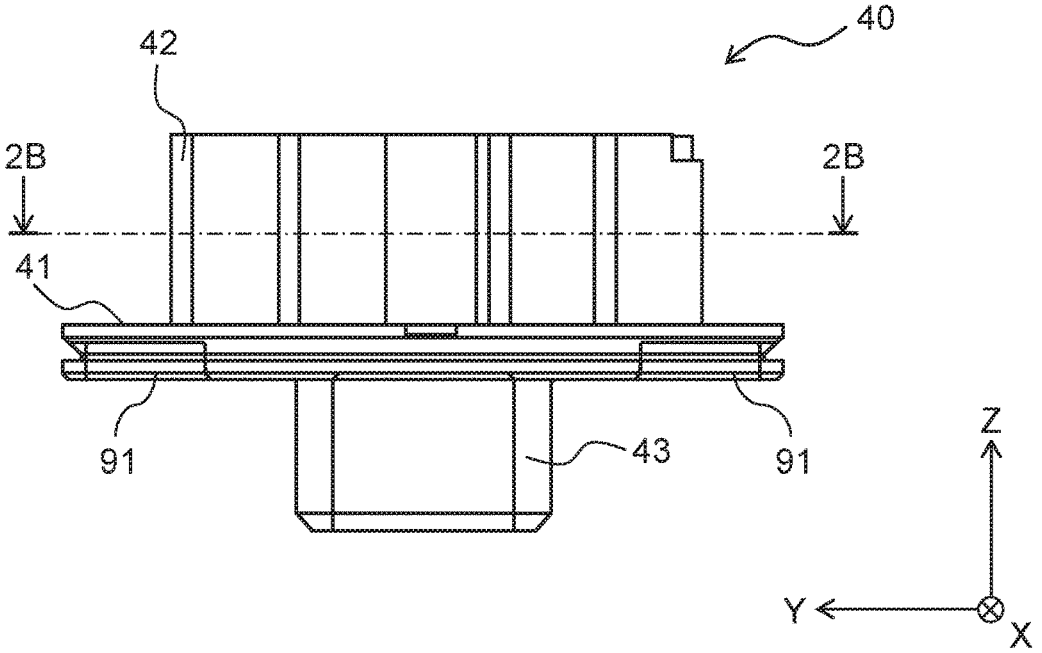
FIG. 2A is a side view illustrating an orbiting scroll of the scroll compressor according to the first exemplary embodiment of the present invention.
Figure 2B:
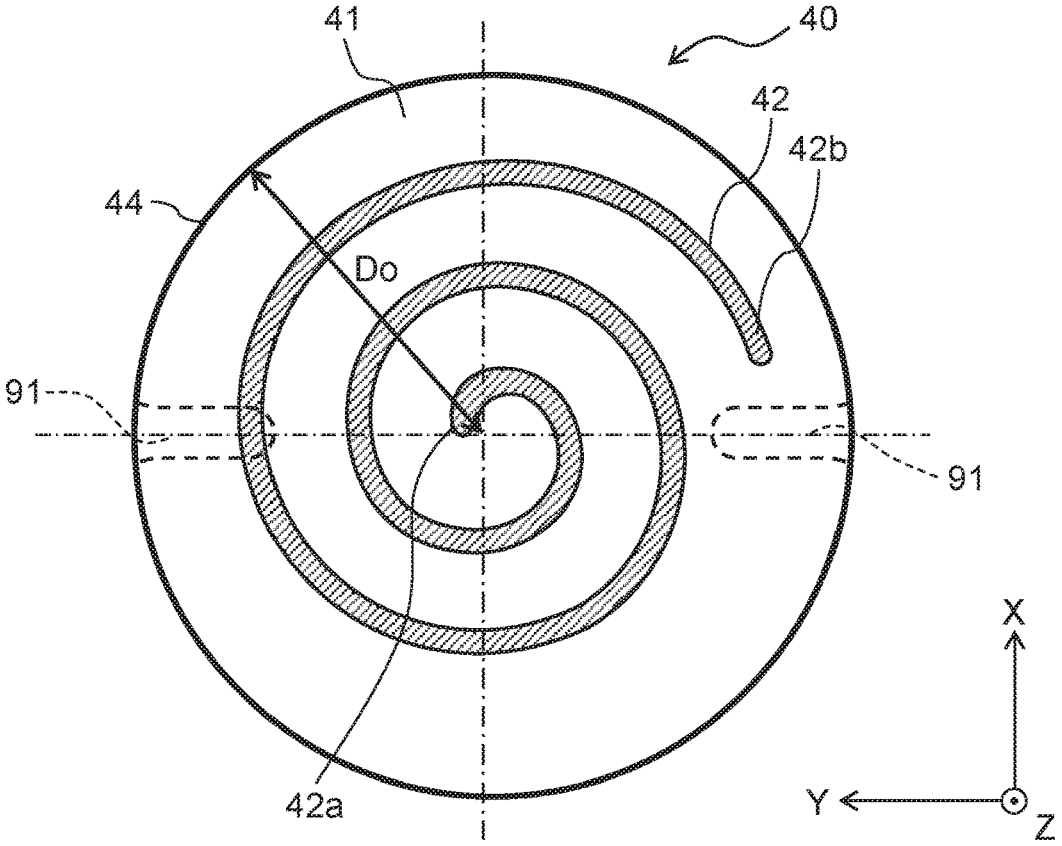
FIG. 2B is a sectional view taken along line 2B-2B in FIG. 2A.

A detailed configuration of compressor 1 will be further described. FIG. 2A is a side view illustrating the orbiting scroll of the scroll compressor according to the present exemplary embodiment. FIG. 2B is a sectional view taken along line 2B-2B in FIG. 2A.

Orbiting spiral wrap 42 is a wall which has an involute curve cross section whose radius gradually increases from a winding start at start end 42*a* located near a center of orbiting scroll end plate 41, toward final end 42*b* located near an outer circumference. Orbiting spiral wrap 42 has a predetermined height (vertical length) and a predetermined wall thickness (radial length of orbiting spiral wrap 42). A pair of first key grooves 91 are respectively disposed at both ends of a lower face of orbiting scroll end plate 41. First key grooves 91 have a longitudinal direction extending from the outer circumference to the center.

Figure 3:
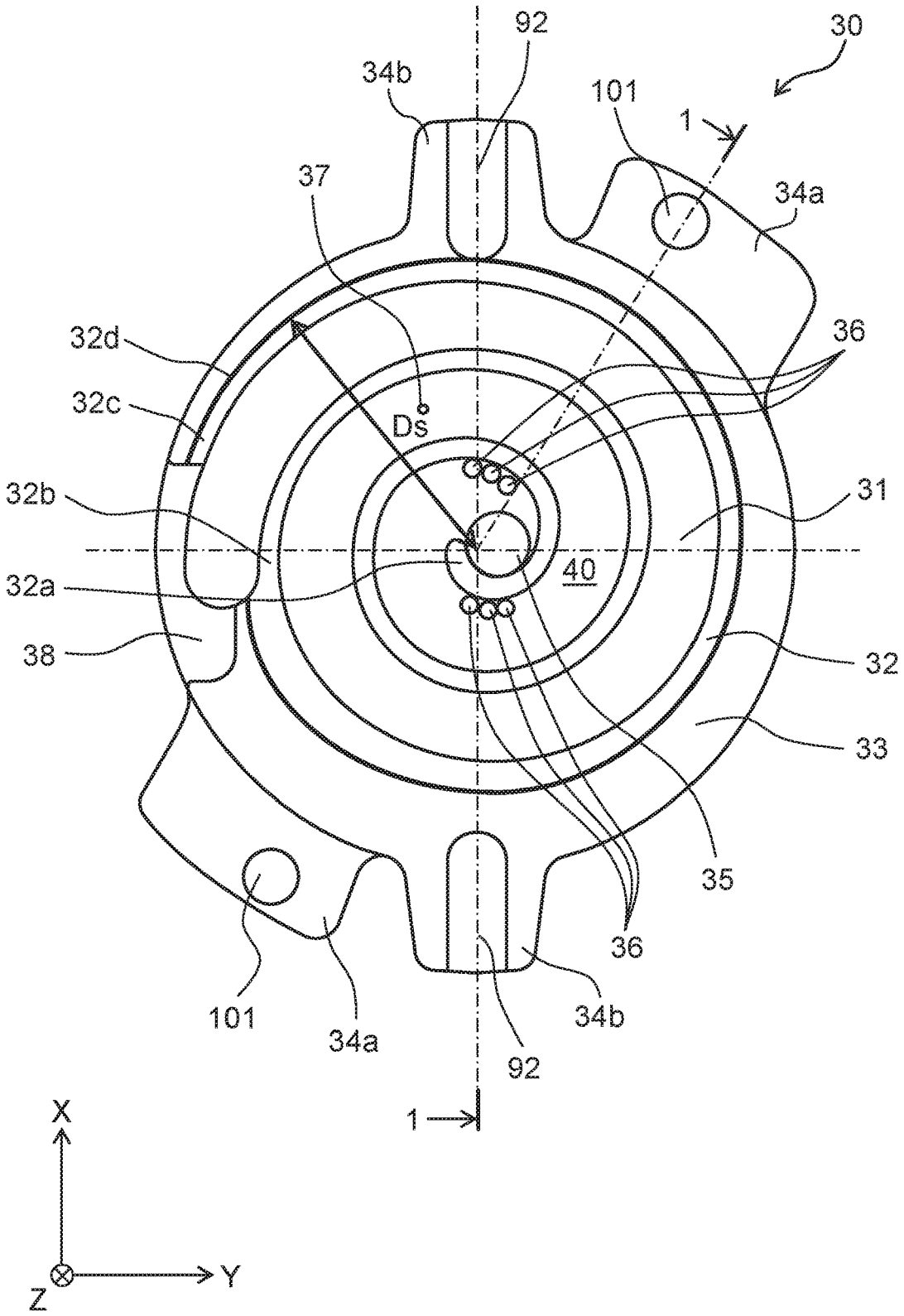
FIG. 3 is a bottom view illustrating a fixed scroll of the scroll compressor according to the first exemplary embodiment of the present invention.
Figure 5:
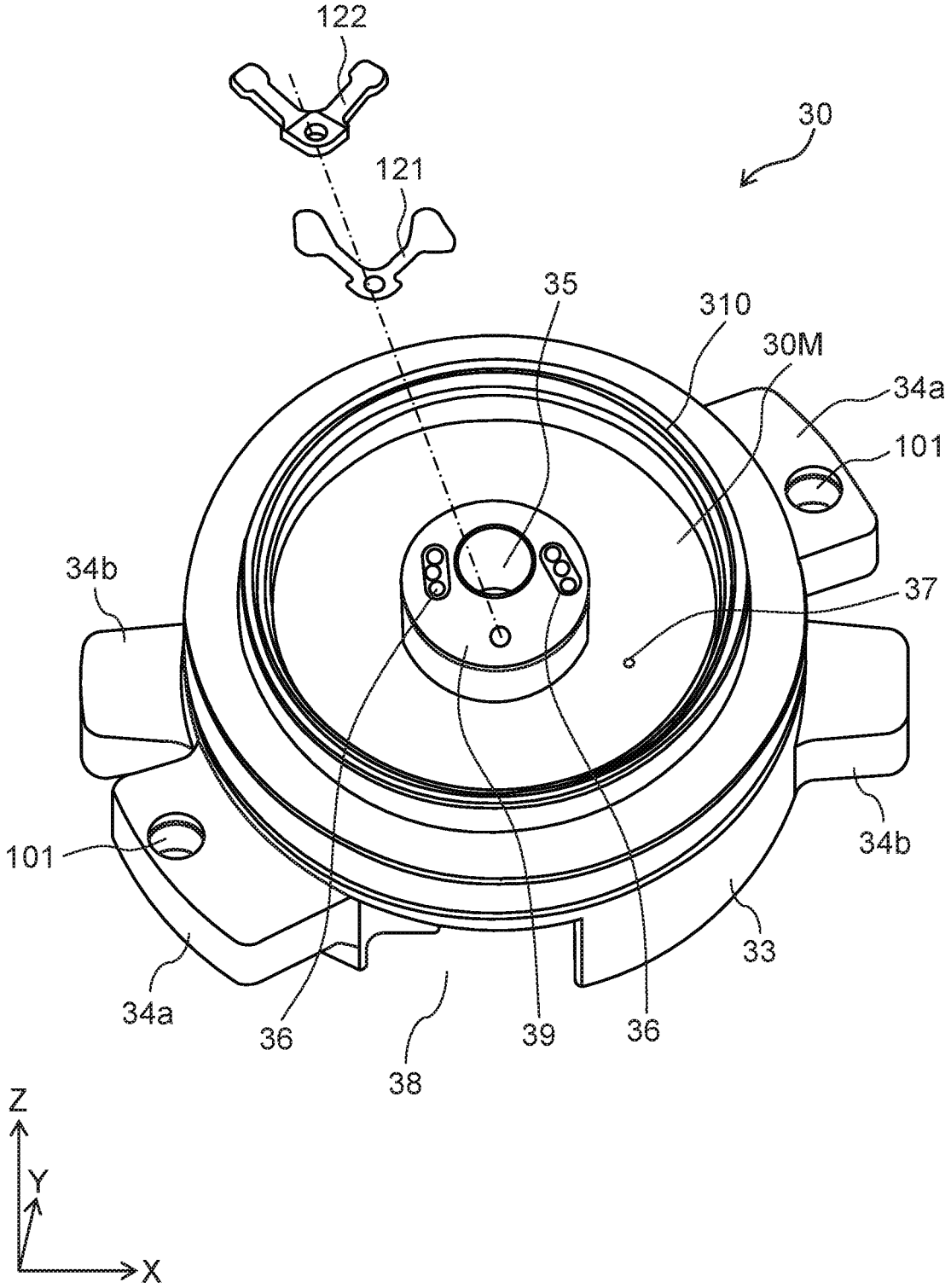
FIG. 5 is a perspective view of the fixed scroll of the scroll compressor according to the first exemplary embodiment of the present invention as viewed from a bottom side.
Figure 6:
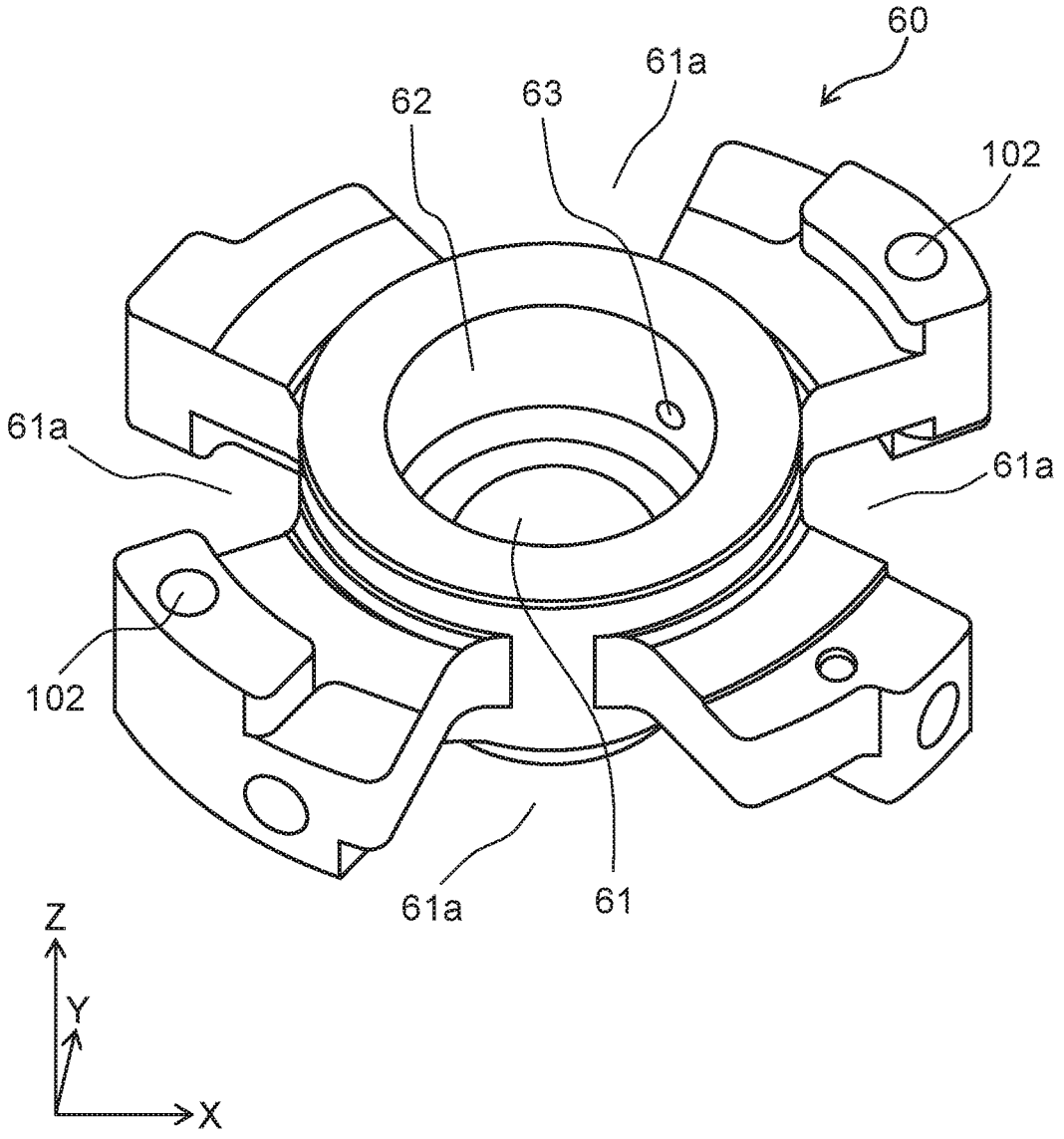
FIG. 6 is a perspective view illustrating a main bearing of the scroll compressor according to the first exemplary embodiment of the present invention.

FIG. 3 is a bottom view illustrating the fixed scroll of the scroll compressor according to the present exemplary embodiment. FIG. 5 is a perspective view of the fixed scroll as viewed from the bottom side. FIG. 6 is an exploded perspective view of the fixed scroll as viewed from the top side.

As illustrated in FIGS. 3 and 5, fixed spiral wrap 32 is a wall which has an involute curve cross section whose radius gradually increases from a winding start at start end 32*a* located near a center of fixed scroll end plate 31 toward final end 32*c* located near an outer circumference. Fixed spiral wrap 32 has a predetermined height (vertical length) equivalent to the height of orbiting spiral wrap 42, and a predetermined wall thickness (radial length of fixed spiral wrap 32).

Fixed spiral wrap 32 has both an inner wall (wall surface on center side) and an outer wall (wall surface on outer circumferential side) from start end 32*a* to intermediate portion 32*b*, and has only the inner wall from intermediate portion 32*b* to final end 32*c*.

According to the present exemplary embodiment, as illustrated in FIG. 3, a distance between the center of fixed scroll end plate 31 and outer circumferential portion 32*d* at a distal end of fixed spiral wrap 32 of fixed scroll 30 is defined as distance Ds. In addition, as illustrated in FIG. 2B, a distance between the center of orbiting scroll end plate 41 and portion 44 included in a bottom face of orbiting spiral wrap 42 of orbiting scroll 40 and facing outer circumferential portion 32*d* of the distal end of fixed spiral wrap 32 of fixed scroll 30 is defined as distance Do. When an orbiting radius of orbiting scroll 40 is $\varepsilon$, the orbiting radius being a distance between the center of driving shaft 70 and the center of eccentric shaft 71, $Ds+\varepsilon \leq Do$ holds.

Figure 4:
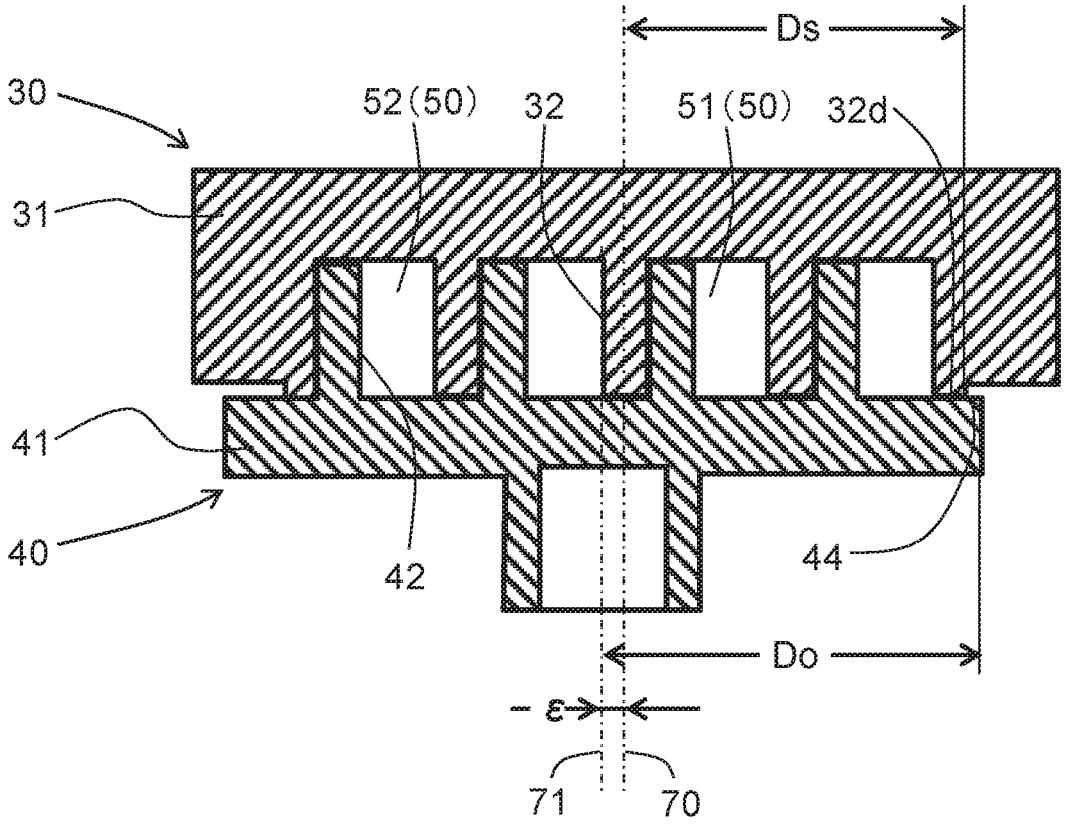
FIG. 4 is a sectional view illustrating a state of engagement between a fixed spiral wrap of the fixed scroll of the scroll compressor and an orbiting spiral wrap of the orbiting scroll of the scroll compressor according to the first exemplary embodiment of the present invention.

FIG. 4 is a sectional view illustrating a state of engagement between fixed spiral wrap 32 of fixed scroll 30 and orbiting spiral wrap 42 of orbiting scroll 40, as a sectional view taken in an orbiting direction. FIG. 4 shows a state where orbiting scroll 40 is shifted leftward with respect to fixed scroll 30, whereby the orbiting direction is the left direction in this state. This configuration is further described with reference to FIG. 4. Distance Do between the center of orbiting scroll end plate 41 and portion 44 included in the bottom face of orbiting spiral wrap 42 of orbiting scroll 40 and facing outer circumferential portion 32*d* at the distal end of fixed spiral wrap 32 of fixed scroll 30 becomes larger, by orbiting radius E or more, than distance Ds between the center of fixed scroll end plate 31 and outer circumferential portion 32*d* at the distal end of fixed spiral wrap 32 of fixed scroll 30. In this case, portion 44 of the bottom of orbiting spiral wrap 42 securely covers outer circumferential portion 32*d* of fixed spiral wrap 32. This condition is applicable to any position in the orbiting direction.

The above configuration of the present exemplary embodiment constantly prevents a drop of outer circumferential portion 32*d* at the distal end of fixed spiral wrap 32 of fixed scroll 30 from orbiting scroll end plate 41 during orbiting of orbiting scroll 40.

In this case, the compressor can be operated without partial contact between the distal end of fixed spiral wrap 32 of fixed scroll 30 and orbiting scroll end plate 41. Accordingly, even when a bend or fall of orbiting scroll 40 is caused during the operation, a stable driving state is constantly maintained without partial contact between outer circumferential portion 32*d* at the distal end of fixed spiral wrap 32 of fixed scroll 30 and portion 44 included in the bottom face of orbiting spiral wrap 42 of orbiting scroll 40 and facing outer circumferential portion 32*d* at the distal end of fixed spiral wrap 32 of fixed scroll 30.

Therefore, prevention of abrasion of components caused by edge contact, and improvement of reliability of the compressor can be achieved. Moreover, sliding losses produced by partial contact decrease, whereby efficiency of the compressor improves.

According to the present exemplary embodiment, a lower end of an opening of suction portion 38 illustrated in FIGS. 3 and 5 is constituted by orbiting scroll 40. In this case, an opening area of suction portion 38 becomes larger than the area produced when the lower end of the opening of suction portion 38 is constituted by fixed scroll 30. Accordingly, flow resistance of refrigerant gas decreases, whereby efficiency of the compressor further improves. According to the present exemplary embodiment, fixed spiral wrap 32 of fixed scroll 30 does not have a distal end in sliding contact with orbiting spiral wrap 42 of orbiting scroll 40. In other words, a final end at the distal end of fixed spiral wrap 32 of fixed scroll 30 is separated from the distal end of fixed spiral wrap 32 in a direction where an involute angle increases. Even in this case, a stable driving state can be maintained without edge contact between the distal end of fixed spiral wrap 32 and orbiting scroll end plate 41 even at the separation portion when the relationship $Ds+\varepsilon \leq Do$ holds.

According to the present exemplary embodiment, a closure capacity of first compression chamber 51 which is compression chamber 50 disposed on the outer wall side of orbiting spiral wrap 42 of orbiting scroll 40 is different from a closure capacity of second compression chamber 52 which is compression chamber 50 disposed on the inner wall side of orbiting spiral wrap 42 of orbiting scroll 40. In other words, closure timing of first compression chamber 51 is different from closure timing of second compression chamber 52. As illustrated in FIG. 3, for enlargement of the closure capacity, a sufficient capacity of first compression chamber 51 can be securely produced by extending the inner wall of fixed scroll 30 to final end 32*c*. The closure capacity becomes maximum when a difference in closure timing reaches 180 degrees.

According to the present exemplary embodiment, a large closure capacity is securely produced. However, outer circumferential portion 32*d* at the distal end of fixed spiral wrap 32 of fixed scroll 30 is disposed further away from the center, in which condition the bottomface of orbiting spiral wrap 42 of orbiting scroll 40 easily drops from the upper face of fixed spiral wrap 32 of fixed scroll 30 during orbiting. Accordingly, the effects of the present invention become remarkable, allowing a stable driving state to be constantly achieved.

Figure 8:
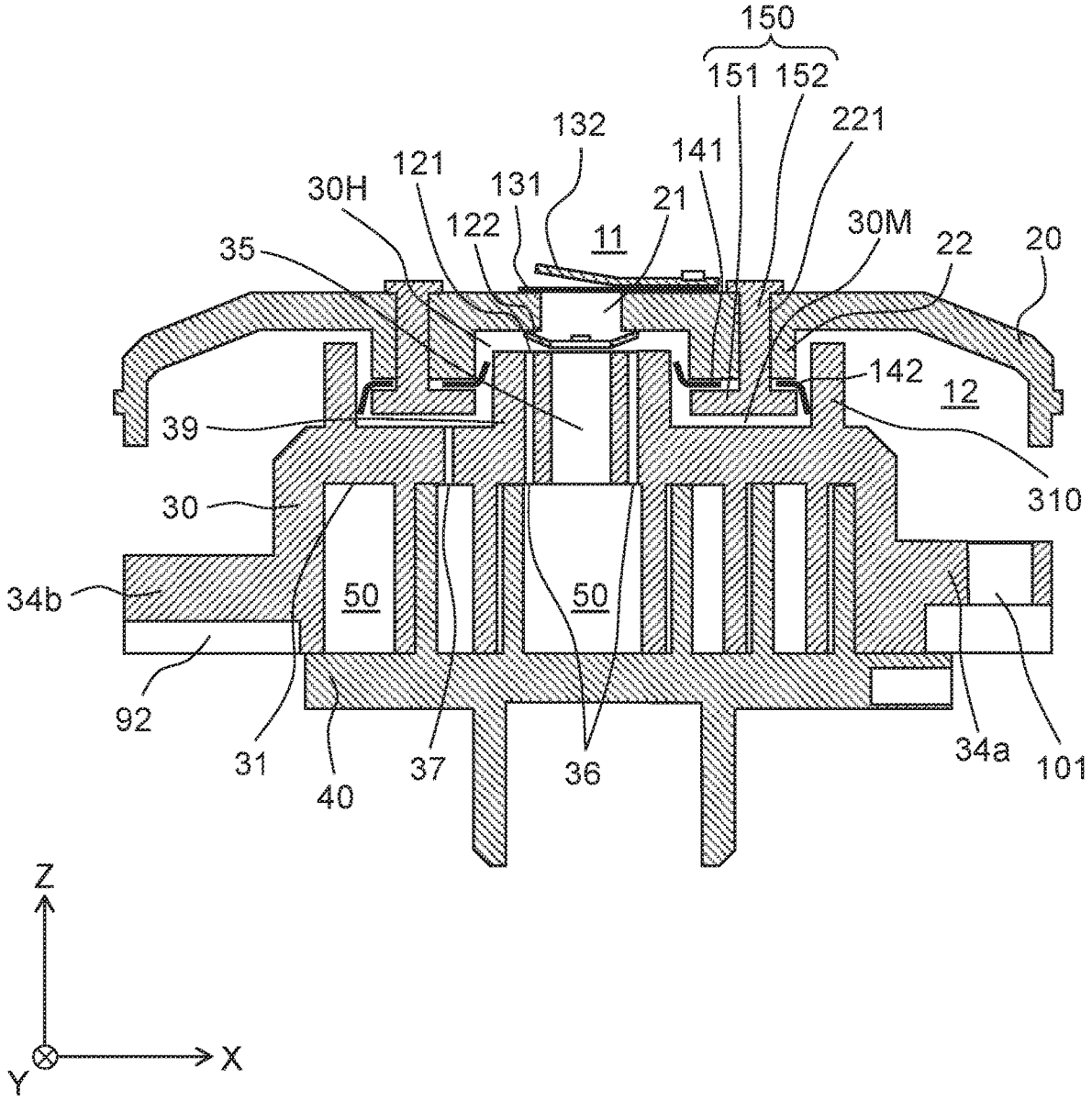
FIG. 8 is a sectional view illustrating a partitioning plate, the fixed scroll, and the orbiting scroll of the scroll compressor according to the first exemplary embodiment of the present invention.

Moreover, according to the present exemplary embodiment, fixed scroll 30 is pressed against orbiting scroll 40 by pressure applied to fixed scroll 30 from discharge space 30H (see FIG. 8). In this manner, a clearance between fixed scroll 30 and orbiting scroll 40 is minimized to prevent refrigerant leakage during compression (details will be described below).

According to this configuration, surface pressure produced between the distal end of fixed spiral wrap 32 of fixed scroll 30 and orbiting scroll end plate 41 increases by a pressing load applied against fixed scroll 30 from discharge space 30H. This configuration therefore more efficiently produces the effects of preventing partial contact and increasing reliability and efficiency by reduction of abrasion of components according to the present exemplary embodiment.

First discharge port 35 is provided substantially at a center portion of fixed scroll end plate 31. Furthermore, bypass port 36 and intermediate pressure port 37 are provided on fixed scroll end plate 31. Bypass port 36 is disposed near first discharge port 35, and in a region where a higher-pressure refrigerant immediately before completion of compression is present.

Bypass port 36 is constituted by two sets of three small holes. One set of three small holes form a bypass port which communicates with first compression chamber 51 provided on the outer wall side of orbiting spiral wrap 42. The other set form a bypass port which communicates with second compression chamber 52 provided on the inner wall side of orbiting spiral wrap 42. Intermediate pressure port 37 is disposed near intermediate portion 32*b* in a region where a middle-pressure refrigerant being compressed is present.

A pair of first flanges 34*a* and a pair of second flanges 34*b* provided on an outer circumferential portion of fixed scroll 30 project from peripheral wall 33 toward the outer circumference. First flanges 34*a* and second flanges 34*b* are provided below fixed scroll end plate 31 (orbiting scroll 40 side) (see FIG. 8). Second flanges 34*b* are provided below first flanges 34*a*. Lower surfaces of second flanges 34*b* (surfaces on orbiting scroll 40 side) are positioned on a plane substantially identical to a distal end face of fixed spiral wrap 32.

The pair of first flanges 34*a* are disposed with a predetermined clearance between each other and substantially at equal intervals in the circumferential direction of driving shaft 70. Similarly, the pair of second flanges 34*b* are disposed with a predetermined clearance between each other and substantially at equal intervals in the circumferential direction of driving shaft 70. As illustrated in FIG. 5, suction portion 38 through which a refrigerant is introduced into compression chamber 50 is disposed in peripheral wall 33 of fixed scroll 30.

In addition, scroll-side hole 101 through which an upper end of corresponding columnar member 100 is inserted is disposed in each of first flanges 34*a*. One scroll-side hole 101 is disposed in each of the pair of first flanges 34*a*. Each of scroll-side holes 101 corresponds to a receiving portion according to the present invention. Two scroll-side holes 101 are disposed with a predetermined clearance between each other in the circumferential direction.

Preferably, two scroll-side holes 101 are disposed at equal intervals in the circumferential direction. Scroll-side holes 101 are not limited to through holes, but may be recesses recessed from the lower face side.

Scroll-side holes 101 communicate with the outside of fixed scroll 30, i.e., lower-pressure space 12 via through holes (not shown).

Second key groove 92 is disposed in each of second flanges 34*b*. One second key groove 92 is disposed in each of the pair of second flanges 34*b*. Second key grooves 92 are a pair of grooves having a longitudinal direction extending from the outer circumference to the center.

As illustrated in FIG. 8, upper boss portion 39 is provided at the center of the upper face of fixed scroll 30 (surface on partitioning plate 20 side). Upper boss portion 39 is a cylindrical projection which projects from the upper face of fixed scroll 30. First discharge port 35 and bypass port 36 are opened to an upper face of upper boss portion 39. Discharge space 30H is disposed between the upper face of upper boss portion 39 and partitioning plate 20 (see FIG. 8 described below). First discharge port 35 and bypass port 36 communicate with discharge space 30H.

Ring-shaped protrusion 310 is provided on the upper face of fixed scroll 30 on the outer circumferential side of upper boss portion 39. An annular recess defined by upper boss portion 39 and ring-shaped protrusion 310 is disposed in the upper face of fixed scroll 30. This recess forms intermediate pressure space 30M (see FIG. 8 described below). Intermediate pressure port 37 is opened to the upper face of fixed scroll 30 (bottom face of recess), and communicates with intermediate pressure space 30M.

A hole radius of intermediate pressure port 37 is smaller than a wall thickness of orbiting spiral wrap 42. This configuration prevents communication between second compression chamber 52 diposed on the inner wall side of orbiting spiral wrap 42 and first compression chamber 51 disposed on the outer wall side of orbiting spiral wrap 42.

Bypass check valve 121 which opens and closes bypass port 36, and bypass check valve stop 122 which prevents excessive deformation of bypass check valve 121 are provided on the upper face of upper boss portion 39. Bypass check valve 121 may be constituted by a reed valve to reduce a size of bypass check valve 121 in a height direction.

By using a V-shaped reed valve, bypass check valve 121 can open and close, with only one reed valve, bypass port 36 communicating with first compression chamber 51 disposed on the outer wall side of orbiting spiral wrap 42, and bypass port 36 communicating with second compression chamber 52 disposed on the inner wall side of orbiting spiral wrap 42.

An intermediate pressure check valve (not shown) which opens and closes intermediate pressure port 37, and an intermediate pressure check valve stop (not shown) which prevents excessive deformation of the intermediate pressure check valve are provided on the upper face of fixed scroll 30 (bottom face of recess). The intermediate pressure check valve may be constituted by a reed valve to reduce a size of the intermediate pressure check valve in the height direction. Alternatively, the intermediate pressure check valve may be constituted by a ball valve and a spring.

FIG. 6 is a perspective view illustrating the main bearing of the scroll compressor according to the present exemplary embodiment as viewed from the top face side.

Bearing-side holes 102 through which lower ends of columnar members 100 are inserted are disposed in an outer circumferential portion of main bearing 60. Two bearing-side holes 102 are disposed with a predetermined clearance between each other in the circumferential direction. Preferably, two bearing-side holes 102 are disposed at equal intervals in the circumferential direction. Bearing-side holes 102 are not limited to through holes, but may be recesses recessed from the upper face side.

Main bearing 60 includes return path 63. One end of return path 63 is opened to boss storage portion 62, while the other end is opened to a lower face of main bearing 60. The one end of return path 63 may be opened to an upper face of main bearing 60. The other end of return path 63 may be opened to a side face of main bearing 60.

Return path 63 also communicates with bearing-side holes 102. Accordingly, lubricant is supplied to bearing-side holes 102 via return path 63.

Figure 7:
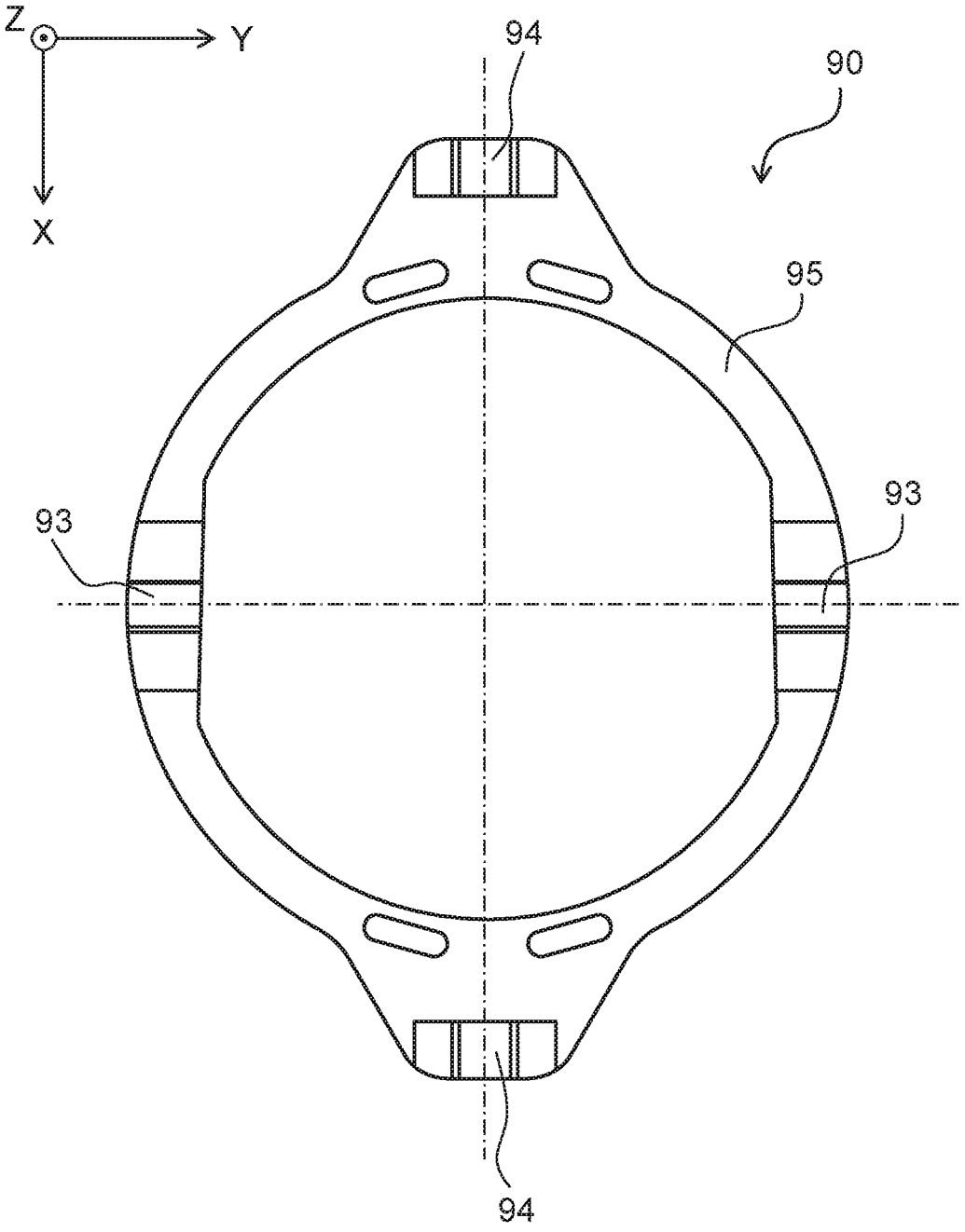
FIG. 7 is a top view illustrating a rotation-restraining member of the scroll compressor according to the first exemplary embodiment of the present invention.

FIG. 7 is a top view illustrating the Oldham ring of the scroll compressor according to the present exemplary embodiment.

Oldham ring 90 includes ring portion 95 having a substantially shape, a pair of first keys 93 and a pair of second keys 94 each projecting from an upper face of ring portion 95. First keys 93 and second keys 94 are provided such that a line connecting two first keys 93 and a line connecting two second keys 94 cross each other at right angles.

First keys 93 engage with first key grooves 91 of orbiting scroll 40, while second keys 94 engage with second key grooves 92 of fixed scroll 30. This configuration allows orbiting scroll 40 to turn without rotation relative to fixed scroll 30.

According to the present exemplary embodiment, fixed scroll 30, orbiting scroll 40, and Oldham ring 90 are disposed in this order from above in the axial direction of driving shaft 70. Accordingly, first keys 93 and second keys 94 are provided on a plane identical to the plane of ring portion 95.

In this configuration, first keys 93 and second keys 94 are allowed to be processed in the same direction at the time of manufacture of Oldham ring 90, whereby the number of times of attachment and detachment of Oldham ring 90 to and from a processing device is decreased. Accordingly, effects of improvement of processing accuracy of Oldham ring 90 and reduction of processing costs can be achieved.

Figure 9:
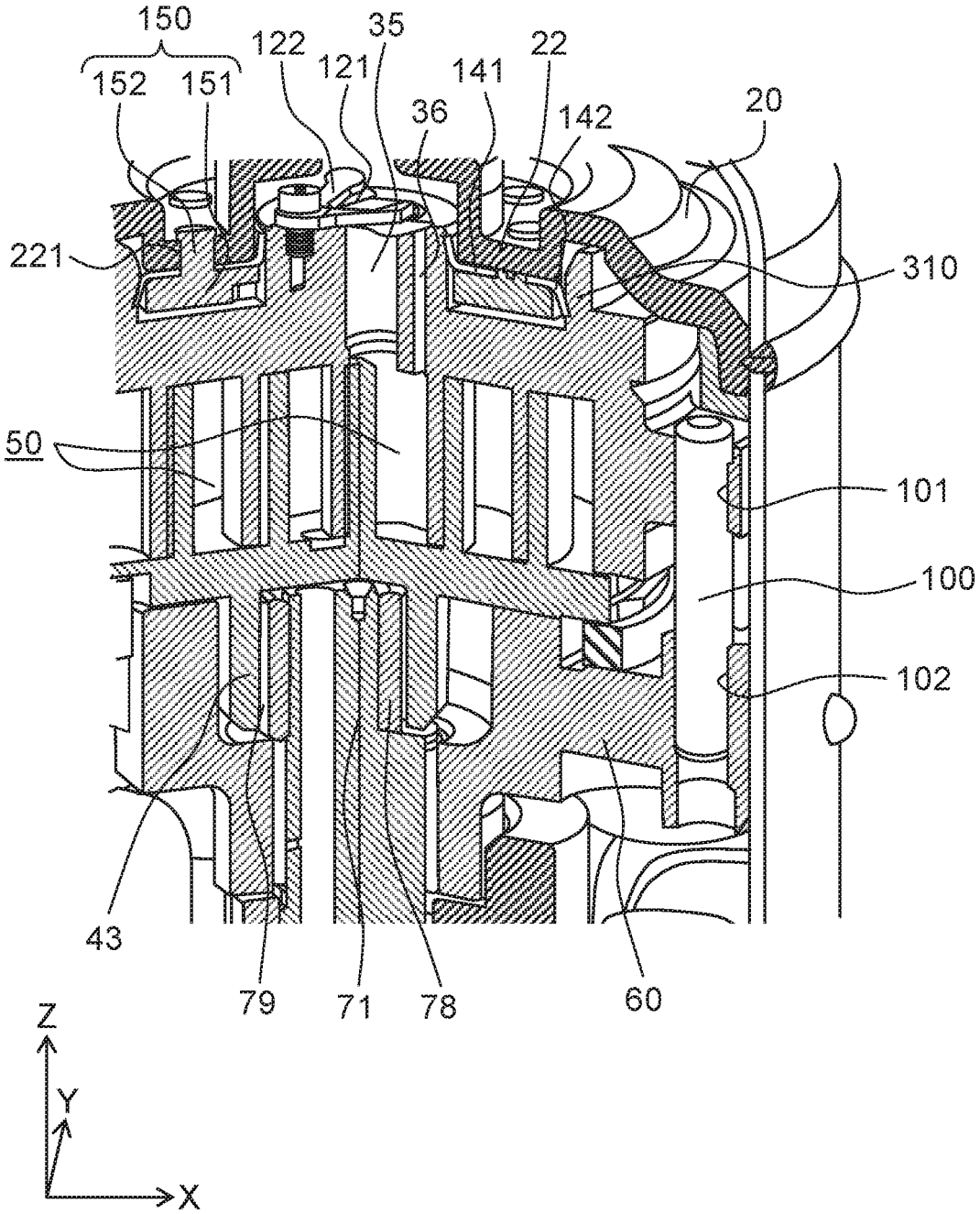
FIG. 9 is a partially sectional perspective view illustrating a main part of the scroll compressor according to the first exemplary embodiment of the present invention.

FIG. 8 is a sectional view illustrating a main part of the scroll compressor according to the present exemplary embodiment. FIG. 9 is a perspective view illustrating a cross section of a main part of the sealed-type scroll compressor according to the present exemplary embodiment.

Second discharge port 21 is disposed at a central portion of partitioning plate 20. Discharge check valve 131 which opens and closes second discharge port 21, and discharge check valve stop 132 which prevents excessive deformation of discharge check valve 131 are provided on an upper face of partitioning plate 20.

Discharge space 30H is diposed between partitioning plate 20 and fixed scroll 30. Discharge space 30H communicates with compression chamber 50 via first discharge port 35 and bypass port 36, and communicates with higher-pressure space 11 via second discharge port 21.

Discharge space 30H communicates with higher-pressure space 11 via second discharge port 21 as described above, whereby back pressure is applied to the upper face of fixed scroll 30. More specifically, high pressure is applied to discharge space 30H, whereby fixed scroll 30 is pressed against orbiting scroll 40. As a result, a clearance between fixed scroll 30 and orbiting scroll 40 can be eliminated, in which condition compressor 1 can perform highly efficient operation.

A plate thickness of discharge check valve 131 is larger than a plate thickness of bypass check valve 121. Accordingly, discharge check valve 131 does not open before bypass check valve 121.

A capacity of second discharge port 21 is larger than a capacity of first discharge port 35. Accordingly, pressure losses of a refrigerant discharged from compression chamber 50 is reduced.

The flow entrance side of second discharge port 21 may be tapered. This configuration further reduces pressure losses.

Projection 22, which annularly projects, is provided on the lower face of partitioning plate 20 around second discharge port 21. A plurality of holes 221, into which a part of closure member 150 (described below) is inserted, are disposed in projection 22.

First seal member 141 and second seal member 142 are provided on projection 22. First seal member 141 is a ring-shaped seal member which projects from projection 22 toward the center of partitioning plate 20. A distal end of first seal member 141 contacts a side face of upper boss portion 39. More specifically, first seal member 141 is disposed between partitioning plate 20 and fixed scroll 30 in a clearance positioned on an outer circumference of discharge space 30H.

Second seal member 142 is a ring-shaped seal member which projects from projection 22 toward the outer circumference of partitioning plate 20. Second seal member 142 is disposed outside first seal member 141. A distal end of second seal member 142 contacts an inner face of ring-shaped protrusion 310. More specifically, second seal member 142 is disposed between partitioning plate 20 and fixed scroll 30 in a clearance positioned on an outer circumference of intermediate pressure space 30M.

In other words, discharge space 30H and intermediate pressure space 30M are disposed between partitioning plate 20 and fixed scroll 30 and defined by first seal member 141 and second seal member 142. Discharge space 30H is a space disposed on the upper face side of upper boss portion 39, while intermediate pressure space 30M is a space disposed on the outer circumferential side of upper boss portion 39.

First seal member 141 is a seal member for dividing discharge space 30H and intermediate pressure space 30M, while second seal member 142 is a seal member for dividing intermediate pressure space 30M and lower-pressure space 12.

For example, polytetrafluoroethylene, which is fluorine resin, is appropriately adopted as materials of first seal member 141 and second seal member 142 in view of sealing and assembly properties. In addition, reliability of sealing improves when first seal member 141 and second seal member 142 are made of a mixture of fluorine resin and fiber material. First seal member 141 and second seal member 142 are sandwiched between closure member 150 and projection 22. In this configuration, partitioning plate 20 is allowed to be disposed within sealed container 10 after first seal member 141, second seal member 142, and closure member 150 are assembled on partitioning plate 20. Accordingly, the number of parts can be reduced, and assembly of the scroll compressor becomes easier.

More specifically, closure member 150 includes ring-shaped portion 151 disposed so as to face projection 22 of partitioning plate 20, and a plurality of projections 152 each projecting from one face of ring-shaped portion 151.

The outer circumferential side of first seal member 141 is sandwiched between the inner circumferential side of an upper face of ring-shaped portion 151 and a lower face of projection 22. The inner circumferential side of second seal member 142 is sandwiched between the outer circumferential side of the upper face of ring-shaped portion 151 and the lower face of projection 22. Accordingly, ring-shaped portion 151 faces the lower face of projection 22 of partitioning plate 20 via first seal member 141 and second seal member 142.

The plurality of projections 152 are inserted into a plurality of holes 221 disposed in projection 22. Upper ends of projections 152 are caulked in such a manner as to press ring-shaped portion 151 against the lower face of projection 22.

More specifically, closure member 150 is fixed to partitioning plate 20 by deformation of each upper end of projections 152 in such a manner as to press ring-shaped portion 151 against the lower face of projection 22. Closure member 150 may be made of aluminum to easily fix closure member 150 to partitioning plate 20 by caulking.

In a state where first seal member 141 and second seal member 142 are attached to partitioning plate 20, an inner circumferential portion of first seal member 141 projects from ring-shaped portion 151 toward the center of partitioning plate 20, while an outer circumferential portion of second seal member 142 projects from ring-shaped portion 151 toward the outer circumference of partitioning plate 20.

By attaching partitioning plate 20 to the inside of sealed container 10 in a state where first seal member 141 and second seal member 142 are attached to partitioning plate 20, the inner circumferential portion of first seal member 141 is pressed against an outer circumferential face of upper boss portion 39 of fixed scroll 30, while the outer circumferential portion of second seal member 142 is pressed against an inner circumferential face of ring-shaped protrusion 310 of fixed scroll 30.

Intermediate pressure space 30M communicates, via intermediate pressure port 37, with a region where a middle-pressure refrigerant being compressed in compression chamber 50 is present. Accordingly, pressure in intermediate pressure space 30M is lower than pressure of discharge space 30H, and higher than pressure in lower-pressure space 12.

In this manner, a force for pressing fixed scroll 30 against orbiting scroll 40 can be easily controlled by using intermediate pressure space 30M disposed between partitioning plate 20 and fixed scroll 30 in addition to discharge space 30H.

Moreover, intermediate pressure space 30M is defined by first seal member 141 and second seal member 142. Accordingly, refrigerant leakage from discharge space 30H to intermediate pressure space 30M, and refrigerant leakage from intermediate pressure space 30M to lower-pressure space 12 can be reduced.

As described above, a scroll compressor according to a first aspect of the invention includes a fixed scroll; an orbiting scroll that engages with the fixed scroll and forms a compression chamber; a rotation-restraining member that prevents rotation of the orbiting scroll; a main bearing that supports the orbiting scroll; a driving shaft supported by the main bearing; and an eccentric shaft provided at one end of the driving shaft. The fixed scroll, the orbiting scroll, the rotation-restraining member, the main bearing, the driving shaft, and the eccentric shaft are stored inside a sealed container The driving shaft and the eccentric shaft are disposed integrally with each other. The eccentric shaft is supported by a boss portion of the orbiting scroll. Assuming that a distance between a center portion of an end plate of the fixed scroll and an outer peripheral portion at a distal end of a fixed spiral wrap of the fixed scroll is Ds, that a distance between a center portion of an end plate of the orbiting scroll and a portion included in a bottom face of an orbiting spiral wrap of the orbiting scroll and facing the outer peripheral portion at the distal end of the fixed spiral wrap of the fixed scroll is Do, and that an orbiting radius of the orbiting scroll is ε, the orbiting radius being a distance between a center of the eccentric shaft and a center of the driving shaft, a relationship $Ds+\varepsilon \leq Do$ is satisfied.

This configuration prevents a drop of a bottom face of the orbiting spiral wrap of the orbiting scroll from an upper face of the fixed spiral wrap of the fixed scroll during orbiting, thereby preventing edge contact and abrasion of components. Moreover, this configuration reduces sliding losses caused by partial contact, thereby increasing operation efficiency.

According to a second aspect of the invention, there are particularly provided, in the first aspect of the invention, a partitioning plate that divides an interior of the sealed container into a higher-pressure space and a lower-pressure space, a first discharge port that is disposed in the fixed scroll, and communicates with the compression chamber, a discharge space that is disposed between the partitioning plate and the fixed scroll, and communicates with the first discharge port, and a second discharge port that is disposed in the partitioning plate, and communicatively connects the discharge space to the higher-pressure space. The fixed scroll may be disposed adjacent to the partitioning plate. The fixed scroll may shift along an axis of the driving shaft between the partitioning plate and the main bearing. The fixed scroll may be pressed against the orbiting scroll by pressure in the discharge space.

This configuration raises surface pressure applied to a bottom face of the orbiting spiral wrap of the orbiting scroll, thereby more effectively producing effects of abrasion reduction and efficiency improvement.

According to a third aspect of the invention, in the first aspect of the invention, a lower end of an opening of a suction portion through which a refrigerant is introduced into the compression chamber may be constituted by the orbiting scroll. This configuration increases an opening area of the suction portion, thereby reducing flow resistance of refrigerant gas, and further improving efficiency of the compressor.

According to a fourth aspect of the invention, in the second aspect of the invention, a lower end of an opening of a suction portion through which a refrigerant is introduced into the compression chamber may be constituted by the orbiting scroll. This configuration increases the opening area of the suction portion, thereby reducing flow resistance of refrigerant gas, and further improving efficiency of the compressor.

According to a fifth aspect of the invention, in any one of the first to fourth aspects of the invention, the compression chamber includes a first compression chamber disposed closer to an outer wall of the orbiting spiral wrap of the orbiting scroll and a second compression chamber disposed closer to an inner wall of the orbiting spiral wrap of the orbiting scroll. The first compression chamber and the second compression chamber may have different closure capacities.

According to this configuration, an outer circumferential portion at a distal end of the fixed spiral wrap of the fixed scroll is disposed further away from the center, in which condition a bottom face of the orbiting spiral wrap of the orbiting scroll easily drops from the upper face of the fixed spiral wrap of the fixed scroll during orbiting. Accordingly, the effects of the present invention become remarkable.

INDUSTRIAL APPLICABILITY

The present invention is applicable to a scroll compressor of a refrigeration cycle device used in electric apparatuses such as water heater, hot water heating system, and air conditioning apparatus.

REFERENCE MARKS IN THE DRAWINGS

1: compressor
10: sealed container
11: higher-pressure space
12: lower-pressure space
13: refrigerant suction pipe
14: refrigerant discharge pipe
15: oil reservoir
16: sub-bearing
20: partitioning plate
21: second discharge port
22: projection
30: fixed scroll
30H: discharge space
30M: intermediate pressure space
31: fixed scroll end plate
32: fixed spiral wrap
32*d*: outer circumferential portion at distal end of fixed spiral wrap
33: peripheral wall
34*a*: first flange
34*b*: second flange
35: first discharge port
36: bypass port
37: intermediate pressure port
38: suction portion
39: upper boss portion
40: orbiting scroll
41: orbiting scroll end plate
42: orbiting spiral wrap
43: lower boss portion
44: portion included in bottom face of orbiting spiral wrap and facing outer circumferential portion of distal end of fixed spiral wrap
50: compression chamber
51: first compression chamber
52: second compression chamber
60: main bearing
61: bearing portion
62: boss storage portion
63: return path
70: driving shaft
71: eccentric shaft
72: oil path
73: suction port
74: paddle
75: first oil filler
76: second oil filler
77: third oil filler
78: swing bush
79: orbiting bearing

80: electric motor
81: stator
82: rotor
90: rotation-restraining member (Oldham ring)
91: first key groove
92: second key groove
93: first key
94: second key
95: ring portion
100: columnar member
101: scroll-side hole
102: bearing-side hole
121: bypass check valve
122: bypass check valve stop
131: discharge check valve
132: discharge check valve stop
141: first seal member
142: second seal member
150: closure member
151: ring-shaped portion
152: projection
170: compression mechanism unit
221: hole
310: ring-shaped protrusion
751: first branch oil path
761: second branch oil path

The invention claimed is:

1. A scroll compressor comprising:

a fixed scroll;

an orbiting scroll that engages with the fixed scroll and forms a compression chamber;

a rotation-restraining member that prevents rotation of the orbiting scroll;

a main bearing that supports the orbiting scroll;

a driving shaft supported by the main bearing; and an eccentric shaft provided at one end of the driving shaft, the fixed scroll, the orbiting scroll, the rotation-restraining member, the main bearing, the driving shaft, and the eccentric shaft being stored inside a sealed container that comprises a partitioning plate dividing an interior of the sealed container into a higher-pressure space and a lower-pressure space, the scroll compressor further comprising:

a first discharge port that is disposed in the fixed scroll, and communicates with the compression chamber;

a discharge space that is disposed between the partitioning plate and the fixed scroll, and communicates with the first discharge port; and a second discharge port that is disposed in the partitioning plate, and communicatively connects the discharge space to the higher-pressure space, wherein the fixed scroll is disposed adjacent to the partitioning plate;

the fixed scroll shifts along an axis of the driving shaft between the partitioning plate and the main bearing;

the fixed scroll is pressed against the orbiting scroll by pressure in the discharge space, the driving shaft and the eccentric shaft are disposed integrally with each other;

the eccentric shaft is supported by a boss portion of the orbiting scroll, and a relationship $Ds+\varepsilon \leq Do$ is satisfied where Ds is a distance between a center portion of an end plate of the fixed scroll and an outer peripheral portion at a distal end of a fixed spiral wrap of the fixed scroll, Do is a distance between a center portion of an end plate of the orbiting scroll and a portion included in a bottom face of an orbiting spiral wrap of the orbiting scroll and facing the outer peripheral portion at the distal end of the fixed spiral wrap of the fixed scroll, and $\varepsilon$ is an orbiting radius of the orbiting scroll, the orbiting radius being a distance between a center of the eccentric shaft and a center of the driving shaft.

2. The scroll compressor according to claim 1, wherein the fixed scroll includes a peripheral wall having a suction portion through which a refrigerant is introduced into the compression chamber; and the suction portion includes an opening having a lower end constituted by the orbiting scroll.

3. The scroll compressor according to claim 1, wherein the compression chamber includes a first compression chamber formed at an outer wall surface side of the orbiting spiral wrap of the orbiting scroll and a second compression chamber formed at an inner wall surface side of the orbiting spiral wrap of the orbiting scroll, the outer wall surface being a surface on an outer circumferential side of the orbiting spiral wrap and the inner wall surface being a surface on a center side of the orbiting spiral wrap, and the first compression chamber and the second compression chamber have different closure capacities.

* * * * *